US007617684B2

(12) United States Patent
Norster

(10) Patent No.: US 7,617,684 B2
(45) Date of Patent: Nov. 17, 2009

(54) IMPINGEMENT COOLED CAN COMBUSTOR

(75) Inventor: Eric Roy Norster, Newark (GB)

(73) Assignee: Opra Technologies B.V., Hengelo (NL)

( * ) Notice: Subject to any disclaimer, the term of this patent is extended or adjusted under 35 U.S.C. 154(b) by 21 days.

(21) Appl. No.: 11/984,055

(22) Filed: Nov. 13, 2007

(65) Prior Publication Data

US 2009/0120094 A1 May 14, 2009

(51) Int. Cl.
*F02C 7/18* (2006.01)
*F23R 3/04* (2006.01)
*F23R 3/54* (2006.01)

(52) U.S. Cl. ..... 60/752; 60/757; 60/760

(58) Field of Classification Search ..... 60/752, 60/760, 755, 757, 748
See application file for complete search history.

(56) References Cited

U.S. PATENT DOCUMENTS

| | | | |
|---|---|---|---|
| 1,171,018 | A | 2/1916 | Blackstone |
| 1,231,799 | A | 7/1917 | Simpson |
| 1,696,799 | A | 12/1928 | Held |
| 1,745,884 | A | 2/1930 | Barnaby |
| 1,941,805 | A | 1/1934 | Lang |
| 2,107,792 | A | 2/1938 | Huesby |
| 2,758,578 | A | 8/1956 | Hopkins |
| 2,766,738 | A | 10/1956 | Hoffman |
| 3,169,367 | A | 2/1965 | Hussey |
| 3,630,024 | A | 12/1971 | Hopkins |
| 4,237,827 | A | 12/1980 | Hamai |

(Continued)

FOREIGN PATENT DOCUMENTS

EP 0 239 020 A2 9/1987

(Continued)

OTHER PUBLICATIONS

International Search Report for PCT/IB2008/003726, dated Jun. 16, 2009.

*Primary Examiner*—Ted Kim
(74) *Attorney, Agent, or Firm*—Finnegan, Henderson, Farabow, Garrett & Dunner, LLP

(57) ABSTRACT

A can combustor includes a generally cylindrical housing having an interior, an axis, and a closed axial end. The closed axial end includes means for introducing fuel to the housing interior. A generally cylindrical combustor liner is disposed coaxially within the housing and configured to define with the housing respective radially outer passages for combustion air and for dilution air, and also respective radially inner volumes for a combustion zone and a dilution zone. The combustion zone is disposed axially adjacent the closed housing end, and the dilution zone is disposed axially distant the closed housing end. The can combustor also includes an impingement cooling sleeve coaxially disposed between the housing and the combustor liner and extending axially from the closed housing end for a substantial length of the combustion zone. The sleeve has a plurality of apertures sized and distributed to direct combustion air against the radially outer surface of the portion of the combustor liner defining the combustion zone, for impingement cooling. Essentially all of the combustion air flows through the impingement cooling apertures prior to admission to the combustion zone. A small portion of the impingement cooling air may be used for film cooling of the liner proximate the closed housing end.

8 Claims, 1 Drawing Sheet

U.S. PATENT DOCUMENTS

| | | | | |
|---|---|---|---|---|
| 4,695,247 | A * | 9/1987 | Enzaki et al. | 60/754 |
| 4,719,748 | A * | 1/1988 | Davis et al. | 60/39.37 |
| 4,858,579 | A | 8/1989 | Elsbett et al. | |
| 5,309,710 | A | 5/1994 | Corr, II | |
| 5,450,724 | A | 9/1995 | Kesseli et al. | |
| 5,511,375 | A | 4/1996 | Joshi et al. | |
| 5,522,357 | A | 6/1996 | Nogi et al. | |
| 5,560,198 | A | 10/1996 | Brewer et al. | |
| 5,564,270 | A | 10/1996 | Kesseli et al. | |
| 5,687,572 | A | 11/1997 | Schrantz et al. | |
| 5,802,854 | A | 9/1998 | Maeda et al. | |
| 6,079,199 | A | 6/2000 | McCaldon et al. | |
| 6,101,814 | A | 8/2000 | Hoke et al. | |
| 6,134,877 | A * | 10/2000 | Alkabie | 60/760 |
| 6,286,300 | B1 | 9/2001 | Zelina et al. | |
| 6,314,716 | B1 * | 11/2001 | Abreu et al. | 60/773 |
| 6,325,039 | B1 | 12/2001 | Goto et al. | |
| 6,412,268 | B1 | 7/2002 | Cromer et al. | |
| 6,484,505 | B1 | 11/2002 | Brown et al. | |
| 6,494,044 | B1 | 12/2002 | Bland et al. | |
| 6,508,620 | B2 | 1/2003 | Sreekanth et al. | |
| 6,532,726 | B2 | 3/2003 | Norster et al. | |
| 6,536,201 | B2 | 3/2003 | Stuttaford et al. | |
| 6,568,187 | B1 | 5/2003 | Jorgensen et al. | |
| 6,615,588 | B2 | 9/2003 | Hoecker | |
| 2002/0043067 | A1 * | 4/2002 | Maeda et al. | 60/776 |
| 2004/0006995 | A1 | 1/2004 | Snyder | |
| 2004/0011041 | A1 | 1/2004 | Inoue | |
| 2004/0065293 | A1 | 4/2004 | Goto | |
| 2004/0120803 | A1 | 6/2004 | Lucas | |
| 2005/0086945 | A1 | 4/2005 | Tiemann | |
| 2005/0141989 | A1 | 6/2005 | Sayegh | |
| 2005/0241317 | A1 | 11/2005 | Martling et al. | |

FOREIGN PATENT DOCUMENTS

| | | | |
|---|---|---|---|
| EP | 0 896 193 | A2 | 2/1999 |
| GB | 2 216 645 | A | 10/1989 |
| JP | 03-45816 | * | 2/1991 |
| JP | 08-270947 | * | 10/1996 |
| WO | WO 99/61841 | | 12/1999 |
| WO | WO 03/044433 | A1 | 5/2003 |
| WO | WO 2008/028621 | A1 | 3/2008 |

* cited by examiner

IMPINGEMENT COOLED CAN COMBUSTOR

BACKGROUND OF THE INVENTION

1. Field of the Invention

The present invention relates to can combustors. In particular, the present invention relates to impingement cooled can combustors for gas turbine engines.

2. Description of the Related Art

Gas turbine combustion systems utilizing can type combustors are often prone to air flow mal-distribution. The problems caused by such anomalies are of particular concern in the development of low NOx systems. The achievement of low levels of oxides of nitrogen in combustors is closely related to flame temperature and its variation through the early parts of the reaction zone. Flame temperature is a function of the effective fuel-air ratio in the reaction zone which depends on the applied fuel-air ratio and the degree of mixing achieved before the flame front. These factors are obviously influenced by the local application of fuel and associated air and the effectiveness of mixing. Uniform application of fuel typically is under control in well designed injection systems but the local variation of air flow is often not, unless special consideration is given to correct mal-distribution.

The achievement of current levels of oxides of nitrogen set by regulations in some areas of the world calls for effective fuel-air ratio to be controlled to low standard deviations on the order of 10%. The cost of development of such combustion systems is high but can be significantly influenced by the right choice of configuration. Manufacturers of gas turbines have different approaches to the configurations which appear straight-forward but often find development troublesome and costly. To further illustrate these facts the configuration in FIG. 1, a schematic of a known impingement cooled can combustor, may be usefully discussed.

As schematically depicted in FIG. 1, can combustor 10 includes housing 12, an inner combustor liner 14, defining a combustion zone 16 and a dilution zone 18, as would be understood by those skilled in the art. Additionally, prior art combustor 10 includes a sleeve 20 having impingement cooling orifices 22 for directing cooling air against the outside surface of liner 14. Combustor 10 is configured to use dilution air for the cooling air, prior to admitting the dilution air to the dilution zone 18 through dilution ports 24. Air for combustion flows along passage 26 directly to swirl vanes 28 where it is mixed with fuel and admitted to combustion zone 16, to undergo combustion. Also depicted in FIG. 1 is a recirculation zone or pattern 32 that is established by the swirling air/fuel mixture and the can component geometry, to stabilize combustion.

The type of configuration shown in FIG. 1 may be used in a simple low NOx combustor where impingement cooling is preferred to that of film cooling. Generally, the use of film cooling in these low flame temperature combustors generates high levels of carbon monoxide emissions. External impingement cooling of the flame tube (liner) can curtail such high levels. The feature that appears initially attractive in the illustrated configuration is the additional use of the impingement air for dilution. However, in systems where high exit temperature is a performance requirement in addition to low NOx, the swirler/reaction zone air flow is a large proportion of total air flow and therefore cooling and dilution air flows are limited. Hence there is considerable advantage in combining these flows to optimize the overall flow conditions. Whereas the aerodynamics would seem to be satisfactory it should be seen that the swirler/reaction zone air flow is open to the effects of any mal-distribution that may be inherent in the incoming flow, namely in air passage 26. The effects of such mal-distribution on swirler/reaction zone fuel-air ratio and NOx are further amplified when the overall pressure loss of the combustor is required to be low.

SUMMARY OF THE DISCLOSURE

A can combustor for use, for example in a gas turbine engine includes a generally cylindrical housing having an interior, an axis, and a closed axial end, the closed axial end including means for introducing fuel to the housing interior. The can combustor also includes a generally cylindrical combustor liner disposed coaxially within the housing and configured to define with the housing respective radially outer passages for combustion air and for dilution air, and respective radially inner volumes for a combustion zone and a dilution zone. The combustion zone is disposed axially adjacent the closed housing end, and the dilution zone is disposed axially distant the closed housing end. The can combustor further includes an impingement cooling sleeve coaxially disposed between the housing and the combustor liner and extends axially from the closed housing end for a substantial length of the combustion zone. The sleeve has a plurality of apertures sized and distributed to direct the combustion air against the radially outer surface of the portion of the combustor liner defining the combustion zone, for impingement cooling. Essentially all of the combustion air flows through the impingement cooling apertures prior to admission to the combustion zone.

The accompanying drawings, which are incorporated in and constitute a part of this specification, illustrate several embodiments of the invention and, together with the description, serve to explain the principles of the invention.

DETAILED DESCRIPTION

Figure 1:
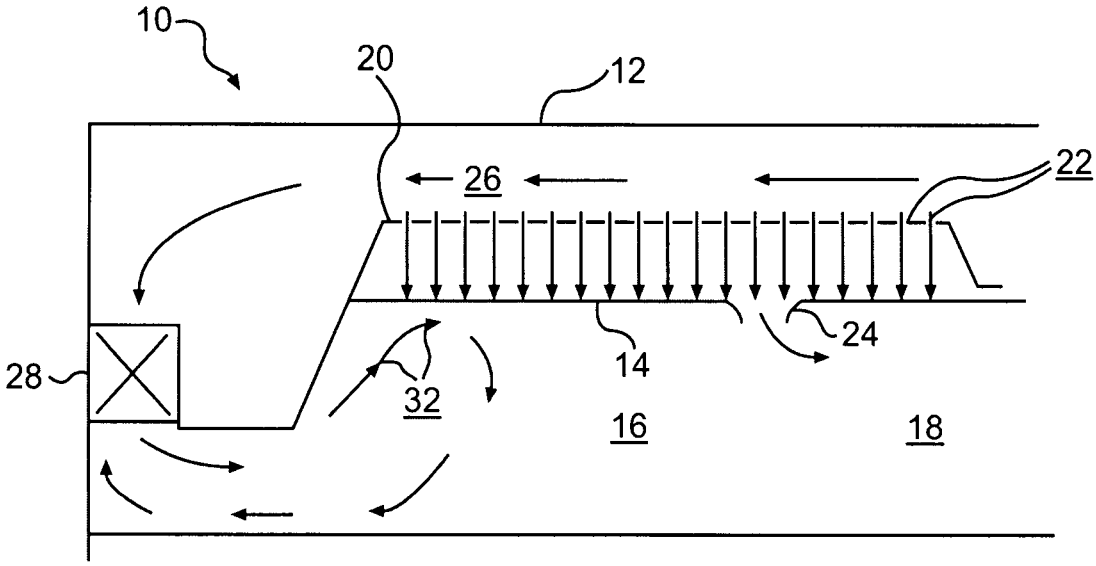
PRIOR ART FIG.1
FIG. 1 is a schematic cross-sectional view of a prior art gas turbine can combustor with impingement cooling.

In accordance with the present invention, as embodied and broadly described herein, the can combustor may include a generally cylindrical housing having an interior, an axis, and a closed axial end. The closed axial end also may include means for introducing fuel to the housing interior. As embodied herein, and with reference to FIG. 2, can combustor 100 includes an outer housing 112 having an interior 114, a longitudinal axis 116, and a closed axial end 118. Housing 112 is generally cylindrical in shape about axis 116, but can include tapered and/or step sections of a different diameter in accordance with the needs of the particular application.

Figure 2:
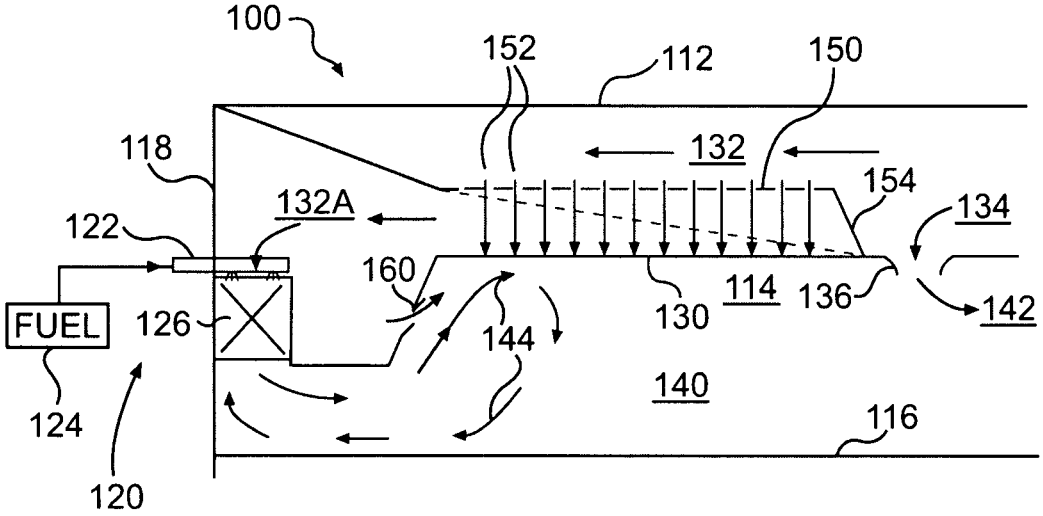
FIG. 2 is a schematic cross-sectional view of a gas turbine can combustor with impingement cooling in accordance with the present invention.

Closed or "head" end 118 includes means, generally designated 120, for introducing fuel into the housing interior 114. In the FIG. 2 embodiment, the fuel introducing means includes a plurality of stub tubes 122 each having exit orifices and being operatively connected to fuel source 124. The fuel introducing means 120 depicted in FIG. 2 is configured for introducing a gaseous fuel (e.g., natural gas) but other applications may use liquid fuel or both gas and liquid fuels. Generally, in some applications, liquid fuels may require an atomizing type of injector, such as "air blast" nozzles (not shown), such as those well known in the art.

Also located at the head end 118 of combustor 100 are a plurality of swirl vanes 126 for imparting swirl to the combustion air being admitted to housing interior 114. Vanes 126 are configured to provide a plurality of separate channels for the combustion air. It is presently preferred that a like plurality of stub tubes 122 be located upstream of vanes 126 and oriented for directing fuel into the entrance of the respective channels, to promote mixing and combustion with low NOx. The stub tubes 122 also may function to meter fuel to combustion zone 140.

Further in accordance with the present invention, as embodied and broadly described herein, can combustor may include a generally cylindrical combustor liner disposed coaxially within the housing and configured to define with the housing, respective radial outer passages for combustion air and for dilution air. The combustor liner may also be configured to define respectively radially inner volumes for a combustion zone and a dilution zone. The combustion zone may be disposed axially adjacent the closed housing end, and the dilution zone may be disposed axially distant the closed housing end.

As embodied herein, and with continued reference to FIG. 2, combustor 100 includes combustor liner 130 disposed within housing 112 generally concentrically with respect to axis 116. Liner 130 may be sized and configured to define respective outer passage 132 for the combustion air and passage 134 for the dilution air. In the FIG. 2 embodiments, passage 134 for the dilution air includes a plurality of dilution ports 136 distributed about the circumference of liner 130.

Liner 130 also defines within housing interior 114, combustion zone 140 axially adjacent closed end 118, where the swirling combustion air and fuel mixture is combusted to produce hot combustion gases. In conjunction with the configuration of closed end 118, including swirl vanes 126, liner 130 is configured to provide stable recirculation in a region or pattern 144 in the combustion zone 140, in a manner known to those skilled in the art. Liner 130 further defines within housing interior 114, dilution zone 142 where combustion gases are mixed with dilution air from passage 134 through dilution ports 136 to lower the temperature of the combustion gases, such as for work-producing expansion in a turbine (not shown).

Still further in accordance with the present invention, as embodied and broadly described and described herein, the can combustor may further include an impingement cooling sleeve coaxially disposed between the housing and the combustion liner and extending axially from the closed housing end for a substantial length of the combustion zone. The impingement cooling sleeve may have a plurality of apertures sized and distributed to direct combustion air against the radially outer surface of the portion of the combustor liner defining the combustion zone, for impingement cooling.

As embodied herein, and with continued reference to FIG. 2, impingement cooling sleeve 150 is depicted coaxially disposed between housing 112 and liner 130. Impingement cooling sleeve 150 extends axially from a location adjacent closed end 118 to a location proximate but upstream of dilution ports 136 relative to the axial flow of the combustion gases. Sleeve 150 includes a plurality of impingement cooling orifices 152 distributed circumferentially around sleeve 150 and configured and oriented to direct combustion air from passage 132 against the outer surface of liner 130 in the vicinity of combustion zone 140.

Significantly, in the embodiments depicted in FIG. 2, essentially all of the combustion air eventually admitted to combustion zone 140 first passes through orifices 152 of impingement sleeve 150 to provide cooling, that is, all except possibly unavoidable leakage. Combustion air may comprise between about 45-55% of the total air supplied to the can combustor (combustion air plus dilution air) for low NOx configurations. Due to the pressure drop across sleeve 150, a substantial reduction in flow velocity differences around the circumference of passage 132*a* immediately upstream of swirler vanes 120 can be achieved, thereby providing improved, more even flow distribution for lean, low NOx operation.

It may be further preferred to utilize a small amount of the impingement cooling air for film cooling locally hot parts of the head end of the combustor and/or proximate portions of the combustor liner. As depicted schematically in FIG. 2, one or more film cooling slots 160 may be provided in closed end 118, which slots are supplied with combustion air that has already traversed the impingement cooling orifices 152, but which typically still has some cooling capacity. Air used for film cooling in the FIG. 2 embodiments (about 8% of the combustion air) eventually is admitted to combustion zone 140 and is therefore available for combustion with the fuel. Moreover, due to the relatively small amount of the air used for film cooling and the generally stable recirculation pattern 144 that can be established in can combustor 100, the use of a small amount of film cooling will not appreciably affect the recirculation pattern 144 or appreciably increase carbon monoxide (CO) generation.

It may alternatively be preferred that the shape of the impingement cooling sleeve 150 in the vicinity of the impingement cooling orifices 152 can be axially tapered, to achieve a frusto-conical shape with an increasing diameter toward the closed (head) end 118 (shown dotted in FIG. 2). In either case, the sleeve end 154 is configured to seal the combustion/impingement cooling air from the dilution air passage after the combustion air has traversed impingement cooling orifices 152.

As a consequence of the features of the can combustor described above, and in addition to the advantage of the more uniform air flow to the swirl vanes discussed previously, the can combustor may provide more uniform pre-mixing in the swirl vanes and, consequently, a higher effective fuel-air ratio for a given NOx requirement. Also, the above-described can combustor may provide a higher margin of stable burning, in terms of providing a more stable recirculation pattern and may also minimize temperature deviations ("spread") in the combustion products delivered to the turbine. Finally, the can combustor disclosed above may also maximize the cooling air requirements and provide minimum liner wall metal temperatures.

It will be apparent to those skilled in the art that various modifications and variations can be made in the disclosed impingement cooled can combustor, without departing from the teachings contained herein. Although embodiments will be apparent to those skilled in the art from consideration of this specification and practice of the disclosed apparatus, it is intended that the specification and examples be considered as exemplary only, with the true scope being indicated by the following claims and their equivalents.

What is claimed is:

1. A can combustor comprising:

a generally cylindrical housing having an interior, an axis, and a closed axial end, the closed axial end including means for introducing fuel to the housing interior;

a generally cylindrical combustor liner disposed coaxially within the housing and configured to define with the housing respective radially outer passages for combustion air and for dilution air, and the liner also defining respective radially inner volumes for a combustion zone and a dilution zone, the combustion zone being disposed axially adjacent the closed housing end, and the dilution zone being disposed axially distant the closed housing end; and a impingement cooling sleeve coaxially disposed between the housing and the combustor liner and extending axially from the closed housing end for a substantial length of the combustion zone to a sleeve closed end, the sleeve having a plurality of apertures sized and distributed to direct combustion air against the radially outer surface of the portion of the combustor liner defining the combustion zone for impingement cooling, the impingement cooled radial outer liner surface being imperforate, wherein the flow of combustion air and dilution air in the radially outer passages is generally axially toward the closed housing end, wherein the dilution air passage includes a plurality of dilution ports in the combustor liner for admitting dilution air radially into the dilution zone, and wherein the combustor liner and the closed axial end are configured such that essentially all of the combustion air flows through the impingement cooling apertures prior to admission to the combustion zone.

2. The can combustor as in claim 1, wherein a portion of the combustion air is further used for film cooling a constricted end of the liner proximate the closed housing end after the portion has traversed the impingement cooling apertures.

3. The can combustor as in claim 2, wherein less than or equal to about 8% of the combustion air is used for film cooling.

4. The can combustor as in claim 1, wherein the impingement cooling sleeve terminates at the liner at an axial position between the closed housing end and the dilution ports.

5. The can combustor as in claim 4, wherein the impingement cooling sleeve is configured to seal off the combustion air from the dilution air passage after the combustion air has traversed the impingement cooling apertures.

6. The can combustor as in claim 1, wherein the impingement cooling sleeve is generally cylindrical in shape.

7. The can combustor as in claim 1, wherein the impingement cooling sleeve is frusto-conical in shape, with a larger diameter being disposed axially adjacent the closed housing end.

8. The can combustor as in claim 1, wherein the combustion air portion of a total of the combustion air and the dilution air is between about 45-55%.

* * * * *